United States Patent [19]

Nahas

[11] 4,284,416

[45] Aug. 18, 1981

[54] INTEGRATED COAL DRYING AND STEAM GASIFICATION PROCESS

[75] Inventor: Nicholas C. Nahas, Baytown, Tex.

[73] Assignee: Exxon Research & Engineering Co., Florham Park, N.J.

[21] Appl. No.: 103,648

[22] Filed: Dec. 14, 1979

[51] Int. Cl.[3] ..... C10J 3/00; C10J 3/54

[52] U.S. Cl. ..... 48/197 R; 48/202; 48/DIG. 7; 252/373

[58] Field of Search ..... 48/197 R, 202, 206, 48/DIG. 7; 252/373; 406/197; 34/10

[56] References Cited

U.S. PATENT DOCUMENTS

| | | | |
|---|---|---|---|
| 2,868,631 | 1/1959 | Woebcke | 48/206 |
| 2,946,670 | 7/1960 | Whaley | 48/206 |
| 2,987,387 | 6/1961 | Carkeek et al. | 48/197 R |
| 3,615,300 | 10/1971 | Holm et al. | 48/202 |
| 3,800,427 | 4/1974 | Kemmetmueller | 34/10 |
| 3,871,839 | 3/1975 | Moody | 48/DIG. 7 |
| 4,118,204 | 10/1978 | Eakman et al. | 48/197 R |
| 4,153,427 | 5/1979 | Bissett et al. | 48/202 |

*Primary Examiner*—Peter F. Kratz
*Attorney, Agent, or Firm*—Yale S. Finkle

[57] ABSTRACT

Carbonaceous solids slurried in an aqueous solution, which preferably contains catalyst constituents having gasification activity, are dried by contacting the slurry with superheated steam in a fluid bed slurry dryer and the resultant dried solids are subsequently gasified with steam generated in the dryer.

26 Claims, 1 Drawing Figure

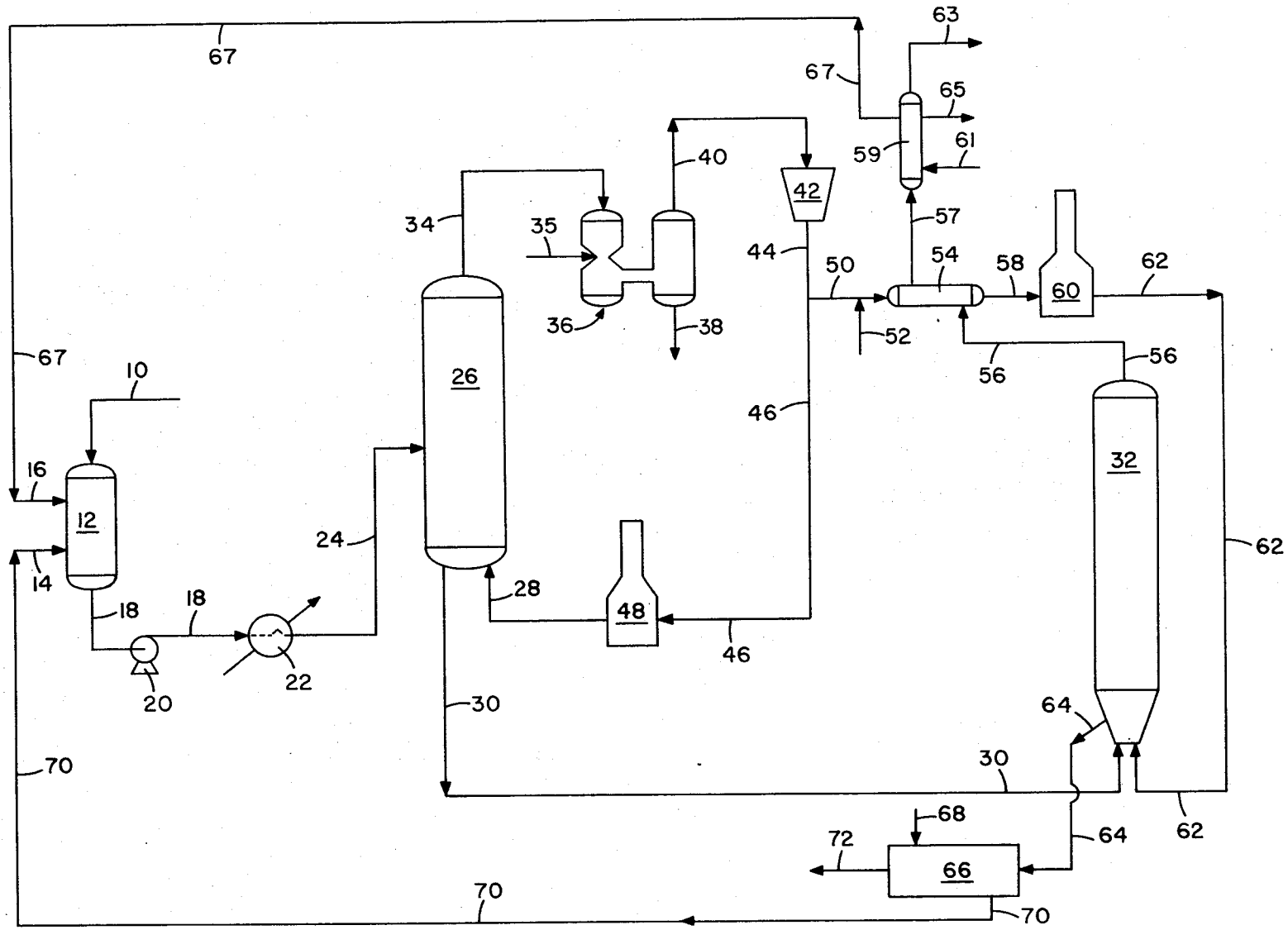
10
12
14
16
18
20
22
24
26
28
30
32
34
35
36
38
40
42
44
46
48
50
52
54
56
57
58
59
60
61
62
63
64
65
66
67
68
70
72

INTEGRATED COAL DRYING AND STEAM GASIFICATION PROCESS

BACKGROUND OF THE INVENTION

This invention relates to the drying and gasification of carbonaceous solids and is particularly concerned with drying an aqueous slurry of coal and the subsequent gasification of the dried coal.

Run-of-mine coal or similar carbonaceous solids will normally contain from about 5 to about 40 weight percent moisture depending upon the type of coal and the geographical area from which it is mined. It is normally desirable to remove this moisture or dry the solids before they are used as fuel to generate steam or otherwise produce heat, or before the solids are used as a feed to liquefaction, gasification, pyrolysis and similar processes wherein the carbonaceous feed material is converted into synthetic liquids and/or gases. Conventional methods for drying coal normally consist of contacting the coal or similar carbonaceous solids with a hot gas to vaporize the water thereby converting it to steam, which is ordinarily vented to the atmosphere. The hot gas may be air, nitrogen, or a similar gas that has been heated to a relatively high temperature. Since the resultant steam is vented to the atmosphere, the energy used to heat the gas is wasted and the drying process is inefficient. In some cases the gas used to dry the coal will be a flue gas produced by combusting a gaseous, liquid or solid fuel. If a flue gas is utilized to vaporize the water, it may contain undesirable constituents such as sulfur dioxide produced when the fuel is combusted and expensive scrubbing equipment may be needed to treat the flue gas after it has contacted the coal in order to prevent undesirable atmospheric emissions.

The inefficiency of drying coal and similar carbonaceous solids becomes more severe in catalytic gasification processes where the coal is impregnated with a catalytically active material prior to injection into the gasifier. The impregnation is normally carried out by mixing the coal with an aqueous solution of the catalyst and the resultant mixture is then dried. In such cases large amounts of heat are required to vaporize the water in the mixture and the resultant steam is vented to the atmosphere and its heat energy lost to the process. In noncatalytic gasification processes, it may be desirable to slurry the feed coal with water, pump the entire slurry to gasifier operating pressure and inject it into the gasifier thereby avoiding the use of complex lock-hopper systems to pressurize dry solids. Heat inefficiency, however, is still a problem in this method since the energy that would normally be utilized to dry the slurry prior to injection into the gasifier must now be supplied directly to the gasifier.

In both catalytic and noncatalytic gasification processes where coal is reacted with excess steam, the resultant raw product gas will contain unreacted steam which must be condensed and removed before the product gas is subjected to further processing. The condensed steam is sour water and contains hydrogen sulfide, ammonia and other impurities that are produced during the gasification step. This sour water must be stripped to remove a portion of these impurities and the stripped sour water then sent to wastewater treatment facilities to further purify the water before it can be reused or placed into the environment. These stripping and wastewater treatment steps are quite costly but are required in almost all steam gasification processes.

SUMMARY OF THE INVENTION

The present invention provides an improved process for drying and gasifying coal or similar carbonaceous solids which at least in part alleviates the difficulties described above. In accordance with the invention, it has now been found that an aqueous slurry of carbonaceous solids can be effectively dried while at the same time recovering and utilizing the heat energy required in the drying step by contacting the aqueous slurry of carbonaceous solids with superheated steam in a drying zone maintained at an elevated temperature and pressure. The superheated steam is maintained at a temperature sufficiently higher than the temperature in the drying zone to convert more than 80 weight percent, preferably more than about 90 weight percent of the water in the slurry into steam. Carbonaceous solids of reduced water content are withdrawn at an elevated temperature and pressure from the drying zone and passed to a steam gasification zone where they are gasified with at least a portion of the steam produced in and withdrawn from the drying zone. By using the steam generated in the drying zone to gasify the carbonaceous solids, the energy used to dry the solids is not lost to the overall process but is used in an efficient and advantageous manner. Since the dried solids removed from the drying zone are at an elevated temperature and pressure, they are particularly suited as feed to a pressurized, high temperature gasification zone.

Normally, a portion of the steam withdrawn from the drying zone is superheated and recycled to the drying zone to supply the required superheated steam. Preferably, the aqueous portion of the slurry is comprised at least in part of sour water produced by condensing the unreacted steam in the effluent from the gasification zone. Such use of the sour water eliminates the need to strip the sour water and pass the stripped sour water to the wastewater treating facilities of the plant. In general, the drying zone will be operated at a pressure in the range between the gasification zone pressure and 200 psi above the gasification zone pressure. The temperature of the steam exiting the drying zone will normally range between the saturation temperature of steam at the drying zone operating pressure and about 200° F. above the saturation temperature.

Although the process of the invention is applicable to any gasification process in which an aqueous slurry of carbonaceous solids is dried with superheated steam and the resultant dried solids are subsequently gasified with the steam produced in the drying step by vaporization of the water in the slurry and in the pores of the carbonaceous solids, the preferred embodiment of the invention is directed to a steam gasification process in which the aqueous portion of the slurry contains a water-soluble compound possessing catalytic gasification activity which is deposited onto the solids during the drying step and thereafter serves as a steam gasification catalyst during the gasification of the carbonaceous solids. The aqueous portion of the slurry may be composed of the solution obtained by leaching the particles produced in the gasification zone. These particles contain catalyst constituents which can be recovered for reuse by leaching with fresh water, a similar aqueous leaching agent such as the sour water that is produced by condensing the unreacted steam in the gaseous effluent from the gasification zone, or a combination of both. If fresh water is used as the leaching agent in the catalyst recovery step, some or all of the sour water may be by-passed around the catalyst recovery unit and added to the catalyst solution exiting the unit. Since the slurry drying step of the process is used to impregnate the catalyst onto the solids and the energy used to dry the solids is recovered by using the generated steam to gasify the solids, the aqueous catalyst solution may be very dilute. This in turn reduces the number of stages needed for leaching the catalyst from the gasifier char since it is not necessary to concentrate the aqueous catalyst solution as would be necessary prior to conventional catalyst impregnation techniques where the energy used to vaporize the water from the slurry is lost to the process.

The process of the invention provides an energy efficient method of drying an aqueous slurry of carbonaceous solids and subsequently gasifying the solids by using the steam generated in the drying step as the gasifying medium thereby advantageously utilizing the energy required to dry the solids.

BRIEF DESCRIPTION OF THE DRAWING

The drawing is a schematic flow diagram of a catalytic coal gasification process carried out in accordance with the invention.

DESCRIPTION OF THE PREFERRED EMBODIMENTS

The process depicted in the drawing is one for the gasification of bituminous coal, subbituminous coal, lignite, coal char, coke, organic material, oil shale, liquefaction bottoms, or similar carbonaceous solids that form part of an aqueous slurry containing a water-soluble compound having catalytic gasification activity in which the aqueous slurry is contacted and dried with superheated steam at an elevated temperature and pressure to convert a substantial portion of the water in the slurry into steam and the resultant dried solids are subsequently gasified with the steam generated in the drying step.

In the process depicted in the drawing, the solid carbonaceous feed material that has been crushed to a particle size of about 8 mesh or smaller on the U.S. Sieve Series Scale is passed into line 10 from a feed preparation plant or storage facility that is not shown in the drawing. The solids introduced into line 10 are fed into slurry tank or similar vessel 12 where they are mixed with an aqueous solution of a water-soluble catalyst introduced into the tank through line 14. The catalyst-containing solution is recycled through line 70 from the catalyst recovery portion of the process, which is described in more detail hereinafter. Normally, the water-soluble catalyst will be an alkali metal hydroxide, carbonate or similar alkali metal salt active in promoting the steam gasification of coal and similar carbonaceous materials. Potassium carbonate is particularly preferred. The aqueous solution introduced through line 14 will normally contain between about 2.0 weight percent and about 30.0 weight percent of the water-soluble catalyst. Normally, a sufficient amount of the aqueous solution is injected into slurry tank 12 such that the solids concentration in the resultant slurry is between about 10 weight percent and about 50 weight percent, preferably between about 30 weight percent and about 40 weight percent. If there is not a sufficient amount of aqueous solution available from the catalyst recovery portion of the process to obtain the desired solids concentration, fresh water or a different aqueous solution may be injected into slurry tank 12 through line 16. This aqueous solution may also contain any make-up catalyst that may be required. Preferably, sour water produced in the downstream processing of the raw product gas generated in the gasification portion of the process is used to supply the additional aqueous portion of the slurry. The source of this sour water is described in more detail hereinafter.

The aqueous slurry of carbonaceous solids formed in slurry tank 12 is withdrawn through line 18 and passed to slurry pump or similar device 20 where its pressure is raised sufficiently to enable the solids to pass through the drying and gasification sections of the process. The high pressure slurry is then passed through heat exchanger or similar device 22 where it is preheated by indirect contact with steam or some other hot fluid to a temperature near the boiling point of the aqueous portion of the slurry. The preheated and pressurized slurry withdrawn from heat exchanger 22 is passed through line 24 into fluid bed slurry dryer or similar device 26.

Slurry dryer 26 contains a fluidized bed of carbonaceous solids extending upward within the vessel above an internal grid or similar distribution device not shown in the drawing. The bed is maintained in the fluidized state by means of superheated steam introduced into the bottom of the dryer through bottom inlet line 28. The aqueous slurry is normally not injected into the bottom of the dryer and is instead introduced into the side of the dryer at a point at least about 5.0 feet above the bottom. The pressure in the fluid bed slurry dryer is normally maintained in a range between the pressure maintained in the gasifier, which is described in detail hereafter, and about 200 psi above the gasifier pressure. The temperature of the steam exiting the dryer will normally range between the saturation temperature of steam at the operating pressure in the dryer and about 200° F. above the saturation temperature at the dryer operating pressure. The residence time of the solids in the dryer will normally range between about 0.20 minutes and about 120 minutes, preferably between about 1.0 minutes and about 30 minutes, and most preferably between about 5.0 minutes and about 10 minutes.

Within the fluidized bed of the slurry dryer, the aqueous feed slurry is contacted with the superheated steam injected into the dryer through line 28. The superheated steam will preferably be at a temperature sufficiently high to convert between about 90 and about 98 weight percent of the water in the slurry into steam. Normally, the superheated steam injected into the dryer will range in temperature between about 50° F. and about 1000° F. above the temperature of the steam withdrawn from the dryer. Since the superheated steam injected into the dryer is at a substantially higher temperature than the temperature maintained in the dryer, the sensible heat in the superheated steam will vaporize a substantial portion of the water in the aqueous slurry thereby converting it into steam. As the water in the feed slurry is converted into steam in the dryer, the water-soluble catalyst is simultaneously impregnated onto the dry carbonaceous solids that comprise the fluidized bed. The dryer is normally operated so that the dry carbonaceous solids produced contain between about 0.1 weight percent and about 10 weight percent water.

The dried carbonaceous solids produced in fluid bed slurry dryer 26 are withdrawn from the dryer through line 30. These solids, impregnated with a catalyst that possesses steam gasification activity, are passed through line 30 into gasifier 32. Since the slurry dryer is operated at a pressure that is normally above the operating pressure of the gasifier, the solids can be directly passed into the gasifier without further pressurization. Thus, the need for sophisticated systems for pressurizing dry solids, such as lock-hoppers, is eliminated.

The gas leaving the fluidized bed in slurry dryer 26 will be comprised primarily of superheated steam but may also contain gaseous impurities produced by devolatilization of the carbonaceous solids under the operating conditions in the dryer. The superheated steam and its impurities, if any, pass through the upper section of the dryer, which serves as a disengagement zone where particles too heavy to be entrained by the gas leaving the vessel are returned to the bed. If desired, this disengagement zone may include one or more cyclone separators or the like for removing relatively large particles from the steam. The steam withdrawn from the upper part of the dryer through line 34 will be at a temperature and pressure approximately equivalent to the temperature and pressure in the dryer. This steam will normally contain a large amount of energy and therefore is particularly suited for use in gasifying the dried carbonaceous solids removed from the dryer and passed to gasifier 32.

The steam withdrawn overhead from slurry dryer 26 through line 34 will contain fine particulates and is therefore passed into venturi scrubber or similar device 36 where the steam is contacted with water introduced into the scrubber through line 35. The water scrubs the fines from the steam thereby forming a slurry which is withdrawn from the scrubber through line 38. The scrubbed steam substantially free of particulates is withdrawn from the venturi scrubber through line 40 and passed to compressor 42 where its pressure is increased to a value from about 25 psi to about 75 psi above the operating pressure in slurry dryer 26. The pressurized steam is withdrawn from compressor 42 through line 44 and a portion of the steam is passed through line 46 to superheater or similar furnace 48 where the steam is superheated to a temperature between about 50° F. and about 1000° F. higher than the temperature of the steam withdrawn from dryer 26 through line 34. The superheated steam exiting furnace 48 is then passed through line 28 into the slurry dryer where its sensible heat serves to convert the water in the feed slurry, which includes the water in the coal pores, into steam while simultaneously heating the feed coal, catalyst constituents and unconverted water to an elevated temperature.

The portion of the steam in line 44 that is not passed through superheater 48 is removed from line 44 through line 50 and if necessary mixed with makeup steam injected into line 50 through line 52. The resultant mixture is then passed to gas-gas heat exchanger 54 where the steam is heated by indirect heat exchange with the effluent from gasifier 32, which is introduced into the exchanger through line 56. The heated steam is then passed through line 58 to preheat furnace or similar device 60 where it is further heated prior to its injection into the gasifier. The preheated steam is withdrawn from furnace 60 and passed through line 62 into gasifier 32 where it is reacted with the dried solids injected into the gasifier via line 30. The dryer may be operated such that substantially all of the steam required in gasifier 32 can be removed from line 44 through line 50 and no makeup steam from any other source will be required.

Gasifier 32 comprises a refactory lined vessel containing a fluidized bed of carbonaceous solids extending upward within the vessel above an internal grid or similar distribution device not shown in the drawing. The solids are maintained in a fluidized state within the gasifier by means of the steam injected into the gasifier through line 62. The pressure in the gasifier will normally be above about 14.7 psig, preferably above about 100 psig, and will normally range between about 200 psig and about 700 psig. The gasifier temperature will normally be maintained between about 1000° F. and about 1500° F., preferably between about 1200° F. and about 1400° F. it will be understood that these pressure and temperature conditions are for catalytic gasification and that if a catalyst is not present in the gasifier the temperature may be much higher. For example, the temperature for noncatalytic gasification may range between about 1500° F. and about 2800° F.

Under the conditions in the gasifier, the steam injected through line 62 reacts with carbon in the carbonaceous solids to produce a gas composed primarily of hydrogen, carbon monoxide and carbon dioxide. Other reactions will also take place and some methane will normally be formed depending on the gasification conditions. The heat required to maintain gasification temperature may be supplied by injecting air or oxygen into the gasifier and burning a portion of the carbon in the solids. In some cases it may be desirable to inject carbon monoxide and hydrogen into the gasifier to prevent any net production of carbon monoxide and hydrogen with the result that the net reaction products are carbon dioxide and methane. Such a system is described in detail in U.S. Pat. Nos. 4,094,650 and 4,118,204, the disclosures of which are hereby incorporated by reference. In such a system heat is supplied by the exothermic reactions that take place in the gasifier upon the injection of carbon monoxide and hydrogen and the use of oxygen or air is normally not required.

The gas leaving the fluidized bed in gasifier 32 passes through the upper section of the gasifier and will normally contain methane, carbon dioxide, hydrogen, carbon monoxide, unreacted steam, hydrogen sulfide, ammonia and other contaminants formed from the sulfur and nitrogen contained in the dried carbonaceous feed material. The gas is withdrawn overhead of the gasifier through line 56 and passed through gas-gas heat exchanger 54 where it is cooled by indirect heat exchange with the steam being fed to the gasifier. The cooled gas is then passed through line 57 into waste heat boiler 59 where it is further cooled by indirect heat exchange with water introduced through line 61 and then passed downstream through line 63 for further processing. Sufficient heat is transferred from the gas to the water to convert it into steam, which is withdrawn through line 65. During this cooling step, unreacted steam in the gas is condensed and withdrawn as sour condensate through line 67. This condensate contains ammonia, hydrogen sulfide and other contaminants and in conventional gasification processes must normally be stripped with steam and passed to wastewater treatment facilities. In the process of this invention, however, all or a portion of this sour water may be passed through line 67 to slurry tank 12 where it can be used to form a portion of the aqueous slurry to be dried in slurry dryer 26. This step may eliminate the need for stripping and reduces the load on the plant wastewater treating facilities thereby increasing the overall efficiency of the gasification process.

Char particles containing carbonaceous material, ash and catalyst residues are continuously withdrawn through line 64 from the bottom of the fluidized bed in gasifier 32 in order to control the ash content of the system and to permit the recovery and recycle of catalyst constituents. The withdrawn solids are passed to catalyst recovery unit 66, which will normally comprise a multistage, countercurrent leaching system in which the char particles are countercurrently contacted with fresh water or some other aqueous solution introduced through line 68. The first stage of the catalyst recovery unit may utilize calcium hydroxide digestion to convert water-insoluble catalyst constituents into water-soluble constituents. Such a digestion process is described in detail in U.S. Pat. No. 4,159,195, the disclosure of which is hereby incorporated by reference. An aqueous solution of water-soluble catalyst constituents is withdrawn from the recovery unit through line 70 and recycled to slurry tank 12 where the solution is mixed with the carbonaceous feed material. Ash residues from which substantially all of the soluble catalyst constituents have been leached are withdrawn from the recovery unit through line 72 and may be disposed of as landfill.

In some cases it may be desirable to utilize the sour condensate withdrawn from waste heat boiler 59 through line 67 as all or a part of the aqueous leaching solution introduced into catalyst recovery unit 66 through line 68. The sour condensate may be used in lieu of or in addition to the fresh water normally injected into the unit through line 68. The use of the sour water in this manner has several advantages. First, it reduces the water requirements of the process by reducing or eliminating the need for fresh water as a leaching agent in the catalyst recovery unit. Second, it reduces the load on the plant's wastewater treatment facilities since the sour water is recycled through the process. Also, as the sour water comes in contact with the basic catalyst constituents, ammonia is liberated from the sour water and can be recovered as product. In some cases it may be desirable to pass all of the sour water in line 67 along with enough fresh water into catalyst recovery unit 66 through line 68 so that the aqueous effluent withdrawn from the recovery unit through line 70 will supply substantially all of the aqueous portion of the slurry formed in mixing tank 12.

In the embodiment of the invention shown in the drawing and described above, carbonaceous solids slurried in an aqueous solution of a water-soluble gasification catalyst are dried by contacting the slurry with superheated steam in a fluid bed slurry dryer operated at an elevated temperature and pressure. The water in the slurry is converted into steam in the dryer and the water-soluble gasification catalyst is simultaneously deposited onto the carbonaceous solids. The steam withdrawn from the dryer is at a relatively high pressure and high temperature and a portion of it is passed to a gasifier where it is used to catalytically gasify the dried solids that are removed from the dryer. This integrated coal drying and gasification system has many advantages. The primary advantage, which is applicable to any embodiment of the invention, is the fact that the energy provided for coal drying is recovered in the form of relatively high pressure and high temperature steam which is used to gasify the dried solids. In addition, this embodiment of the invention has numerous other advantages. The dried coal removed from the dryer, like the steam produced in the dryer, is also at a high temperature and high pressure and can be fed directly to the gasifier without the need for sophisticated solids pressurizing devices such as lock-hoppers. Since the coal is at a higher temperature than in normal gasification processes, the amount of heat required in the gasifier to preheat the coal is substantially reduced. This in turn reduces the outlet temperature of the gasifier preheat furnace which introduces substantial heat economies into the system. Since sour water is used to form the slurry in the embodiment of the invention shown in the drawing, the wastewater treating load is substantially reduced and this fact along with the recovery of the aqueous portion of the slurry for use as steam substantially reduces the water requirements of the overall gasification process.

It will be apparent from the foregoing that the process of the invention provides a method for drying a slurry of carbonaceous solids in which the energy utilized for drying is recovered in the form of useful high temperature and high pressure steam. As a result, the subsequent use of the recovered steam to gasify the dried solids efficiently utilizes the energy required in the drying step.

I claim:

1. A process for drying an aqueous slurry of carbonaceous solids containing water-soluble gasification catalyst constituents and subsequently gasifying the dried solids which comprises:

(a) contacting said aqueous slurry of carbonaceous solids containing said water-soluble gasification catalyst constituents with superheated steam in a fluidized bed drying zone, said superheated steam having a temperature sufficiently higher than the temperature in said drying zone to convert more than about 80 weight percent of the water in said slurry into steam and to deposit said water-soluble gasification catalyst constituents onto said carbonaceous solids;

(b) withdrawing carbonaceous solids of reduced water content and impregnated with said gasification catalyst constituents from said drying zone and passing said solids to a gasification zone maintained at gasification conditions;

(c) withdrawing steam from said drying zone and passing at least a portion of said steam to said gasification zone; and (d) gasifying said catalyst impregnated carbonaceous solids in said gasification zone with said steam passed to said gasification zone.

2. A process as defined in claim 1 wherein said carbonaceous solids comprise coal.

3. A process as defined in claim 1 wherein a portion of said steam withdrawn from said drying zone is superheated and recycled to said drying zone to provide said superheated steam.

4. A process as defined in claim 1 wherein the aqueous portion of said slurry comprises sour water produced by condensing unreacted steam from the gaseous effluent exiting said gasification zone.

5. A process as defined in claim 1 wherein said drying zone is maintained at a pressure in the range between the pressure in said gasification zone and about 200 psi above said gasification pressure, and the temperature of the steam withdrawn from said drying zone is maintained between the saturation temperature of steam at the pressure in said drying zone and about 200° F. above said saturation temperature.

6. A process as defined in claim 1 wherein between about 90 weight percent and about 98 weight percent of the water in said aqueous slurry is converted to steam in said drying zone.

7. A process as defined in claim 1 wherein said carbonaceous solids removed from said drying zone contain between about 0.1 weight percent and about 10 weight percent water.

8. A process as defined in claim 1 wherein said aqueous slurry of carbonaceous solids is introduced into the side of said fluid bed slurry dryer at a point at least 5.0 feet above the bottom and said superheated steam is introduced into the bottom of said dryer.

9. A process for drying an aqueous slurry of carbonaceous solids and subsequently catalytically gasifying the dried solids which comprises:

(a) mixing carbonaceous solids with an aqueous solution containing water-soluble gasification catalyst constituents to form said aqueous slurry of carbonaceous solids;

(b) contacting said aqueous slurry of carbonaceous solids with superheated steam in a fluidized bed drying zone, said superheated steam having a temperature sufficiently higher than the temperature in said drying zone to convert more than about 80 weight percent of the water in said slurry into steam and to deposit said water-soluble gasification catalyst constituents onto said carbonaceous solids;

(c) withdrawing carbonaceous solids having a reduced water content and impregnated with said gasification catalyst constituents from said drying zone and passing said solids to a gasification zone maintained at catalytic steam gasification conditions;

(d) withdrawing steam from said drying zone and passing a portion of said steam to said gasification zone;

(e) gasifying said catalyst impregnated carbonaceous solids in said gasification zone with said steam passed to said gasification zone to produce char particles containing catalyst residues and a gaseous effluent containing unreacted steam;

(f) contacting said char particles with an aqueous leaching agent to form an aqueous solution of water-soluble gasification catalyst constituents; and (g) using said aqueous solution from step (f) in step (a) to form said aqueous slurry of carbonaceous solids.

10. A process as defined in claim 9 including the additional steps of condensing said unreacted steam in said gaseous effluent to produce sour water and using at least a portion of said sour water in step (a) to form said aqueous slurry of carbonaceous solids.

11. A process as defined in claim 10 wherein substantially all of said sour water is used in step (a) to form said aqueous slurry of carbonaceous solids.

12. A process as defined in claim 9 including the additional steps of condensing said unreacted steam in said gaseous effluent to produce sour water and using at least a portion of said sour water as said aqueous leaching agent in step (f).

13. A process as defined in claim 12 wherein substantially all of said sour water is used as said aqueous leaching agent in step (f).

14. A process as defined in claim 9 wherein said carbonaceous solids comprise coal.

15. A process as defined in claim 9 wherein a portion of said steam withdrawn from said drying zone is superheated and recycled to said drying zone to provide said superheated steam.

16. A process as defined in claim 15 wherein substantially all of said steam withdrawn from said drying zone that is not superheated and recycled to said drying zone is passed to said gasification zone.

17. A process as defined in claim 9 wherein substantially all of said steam required in said gasification zone is generated in said drying zone.

18. A process as defined in claim 9 wherein said gasification catalyst constituents comprise an alkali metal carbonate.

19. A process for drying an aqueous slurry of coal and subsequently catalytically gasifying the dried coal which comprises:

(a) mixing coal with an aqueous solution containing water-soluble gasification catalyst constituents to form said aqueous slurry of coal;

(b) contacting said aqueous slurry of coal with superheated steam in a fluidized bed drying zone, said superheated steam having a temperature sufficiently higher than the temperature in said drying zone to convert more than about 80 weight percent of the water in said slurry into steam and to simultaneously deposit said water-soluble gasification catalyst constituents onto said coal;

(c) withdrawing coal having a reduced water content and impregnated with said gasification catalyst constituents from said drying zone and passing said coal to a gasification zone maintained at catalytic steam gasification conditions;

(d) withdrawing steam from said drying zone;

(e) passing a portion of said steam withdrawn from said drying zone through a superheater and recycling it to said drying zone to provide said superheated steam;

(f) passing the remainder of said steam withdrawn from said drying zone to said gasification zone;

(g) gasifying said catalyst impregnated coal in said gasification zone with said steam passed to said gasification zone to produce char particles containing catalyst residues and a gaseous effluent containing unreacted steam;

(h) contacting said char particles with an aqueous leaching agent to form an aqueous solution of water-soluble gasification catalyst constituents;

(i) using said aqueous solution from step (h) in step (a) to form said aqueous slurry of coal;

(j) condensing said unreacted steam in said gaseous effluent from said gasification zone to produce sour water; and (k) using at least a portion of said sour water in step (a) to form said aqueous slurry of coal.

20. A process as defined in claim 19 wherein said aqueous leaching agent comprises fresh water.

21. A process as defined in claim 19 wherein said aqueous leaching agent comprises at least a portion of said sour water.

22. A process as defined in claim 19 wherein said aqueous leaching agent comprises substantially all of said sour water.

23. A process as defined in claim 19 wherein said aqueous leaching agent consists essentially of fresh water and substantially all of said sour water.

24. A process as defined in claim 23 wherein said aqueous solution of water-soluble gasification catalyst constituents formed in step (h) comprises substantially all of the aqueous portion of the slurry formed in step (a).

25. A process as defined in claim 19 wherein said gasification catalyst constituents comprise potassium carbonate.

26. A process as defined in claim 19 wherein the steam passed to said gasification zone in step (f) supplies substantially all of the steam required in said gasification zone and no steam from another source is introduced into said gasification zone.

* * * * *